US005855285A

United States Patent [19]

Laird et al.

[11] Patent Number: 5,855,285

[45] Date of Patent: Jan. 5, 1999

[54] SOCKET HOLDER SYSTEM

[75] Inventors: Gene E. Laird; Deena L. Iannella, both of 508 E. Stonebridge Dr., Gilbert, Ariz. 85234; Diane M. Fales; Kevin A. Fales, both of Gilbert, Ariz.

[73] Assignees: Gene E. Laird, Gilbert, Ariz.; Deena L. Iannella, Chandler, Ariz.

[21] Appl. No.: 567,098

[22] Filed: Dec. 4, 1995

[51] Int. Cl.[6] ..... A47F 7/00

[52] U.S. Cl. ..... 211/70.6; 206/378

[58] Field of Search ..... 211/70.6, 69, 69.5; 224/904, 906; 206/349, 378, 362, 364; 248/314; 403/381

[56] References Cited

U.S. PATENT DOCUMENTS

| | | | |
|---|---|---|---|
| D. 343,975 | 2/1994 | Penalver, Jr. | D6/567 |
| 2,371,433 | 3/1945 | Davis | 211/60 |
| 2,619,829 | 12/1952 | Tatum | 72/41 |
| 2,907,137 | 10/1959 | Ehrmann | 46/25 |
| 2,955,239 | 10/1960 | Rouse | 211/DIG. 1 |
| 3,179,255 | 4/1965 | De'Caccia | 211/60 |
| 3,731,819 | 5/1973 | Sandhage | 211/74 |
| 4,337,860 | 7/1982 | Carrigan | 206/376 |
| 4,405,108 | 9/1983 | Muirhead | 211/DIG. 1 |
| 4,410,095 | 10/1983 | Dembicks | 211/60 |
| 4,421,230 | 12/1983 | Stanton | 206/378 |
| 4,621,738 | 11/1986 | DeLucchi | 211/70.6 |
| 4,717,106 | 1/1988 | Bies et al. | 248/309 |
| 4,802,580 | 2/1989 | Andersen | 211/DIG. 1 X |
| 4,805,783 | 2/1989 | Mayer | 211/94 |
| 4,927,020 | 5/1990 | Randy | 206/378 |
| 5,004,103 | 4/1991 | Connors et al. | 211/70.6 X |
| 5,078,270 | 1/1992 | Campbell | 211/194 X |
| 5,080,230 | 1/1992 | Winnard | 211/DIG. 1 X |
| 5,267,659 | 12/1993 | Fickling et al. | 211/40 |
| 5,284,245 | 2/1994 | Slivon et al. | 206/378 |
| 5,313,181 | 5/1994 | Negus | 335/285 |
| 5,398,823 | 3/1995 | Anders | 206/378 X |
| 5,407,063 | 4/1995 | Warner et al. | 206/45.15 |
| 5,409,560 | 4/1995 | Hammer et al. | 206/378 X |
| 5,447,243 | 9/1995 | Graber | 211/70.6 |
| 5,462,177 | 10/1995 | O'Donnell | 211/40 |
| 5,512,165 | 4/1996 | Liu | 206/378 X |
| 5,551,320 | 9/1996 | Horobec et al. | 206/378 X |
| 5,551,795 | 9/1996 | Engibarov | 403/381 |
| 5,660,276 | 8/1997 | Winnard | 206/350 |

FOREIGN PATENT DOCUMENTS

| | | | |
|---|---|---|---|
| 104866 | 4/1984 | European Pat. Off. | 211/70.6 |
| 8401121 | 3/1984 | WIPO | 211/70.6 |
| 9423909 | 10/1994 | WIPO | 211/70.6 |

*Primary Examiner*—Leslie A. Braun
*Assistant Examiner*—Anita M. King
*Attorney, Agent, or Firm*—Frank J. McGue

[57] ABSTRACT

A socket holding system is disclosed which comprises a plurality of interlocking socket holders, each of said holders comprising a base and means for holding sockets mounted thereon. Each base interlocks with other bases, preferably, using a tongue and groove combination. Further, each base is secured to a substrate.

16 Claims, 3 Drawing Sheets

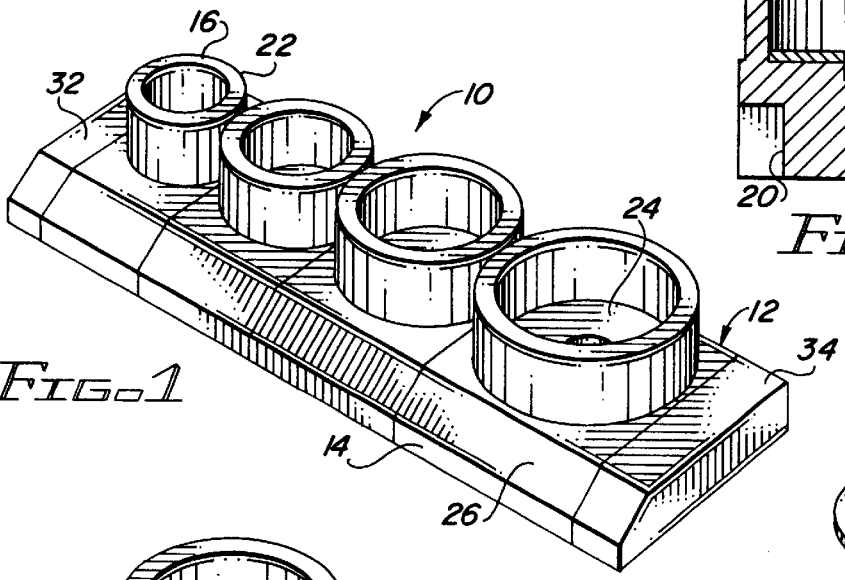
FIG. 1
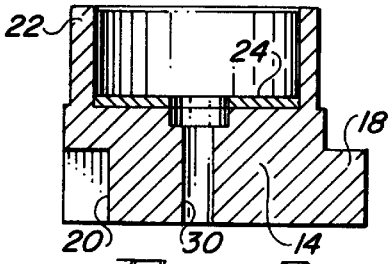
FIG. 3
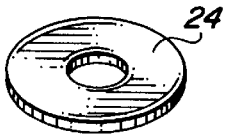
FIG. 6
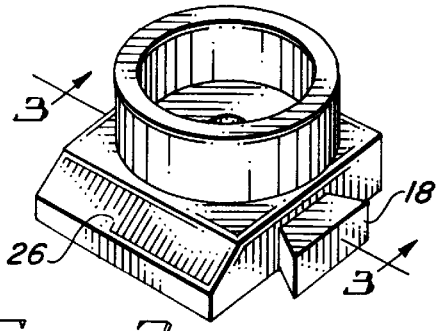
FIG. 2
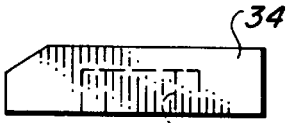
FIG. 7
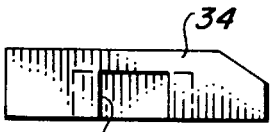
FIG. 8
FIG. 4
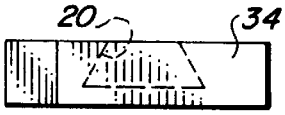
FIG. 9
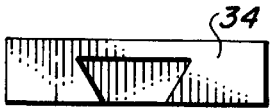
FIG. 10
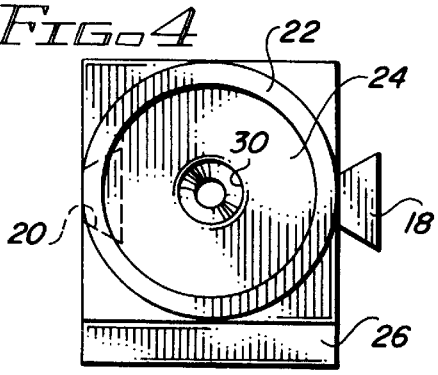
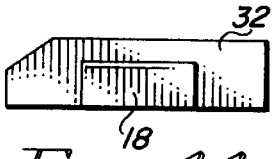
FIG. 11
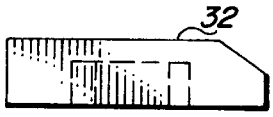
FIG. 12
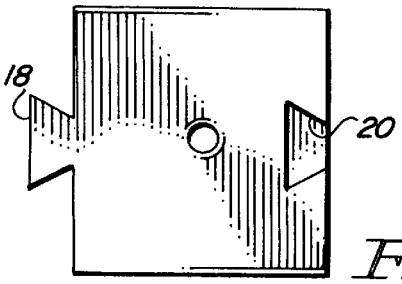
FIG. 5
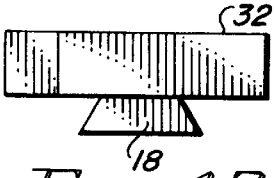
FIG. 13
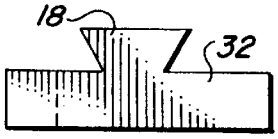
FIG. 14

SOCKET HOLDER SYSTEM

TECHNICAL FIELD

This invention relates to socket holder systems, and, more particularly, to socket holder systems which can be customized by the user as needed.

BACKGROUND OF THE INVENTION

Various types of socket holders have been described in the literature.

U.S. Pat. No. 2,371,433 entitled "Tool Supporting Rack" which issued on Mar. 13, 1945 to Davis discloses a tool supporting rack which comprises tool supporting sockets slidably mounted in a channel bar secured to a suitable substrate such as a wall.

U.S. Pat. No. 3,179,255 entitled "Holder for Tools" which issued on Apr. 20, 1965 to De'Caccia shows a tool holder comprising tool holding sockets slidably mounted on a wire frame.

U.S. Pat. No. 4,337,860 entitled "Detachable Wrench Set Organizer and Storage Unit" which issued on Jul. 6, 1982 to Carrigan discloses a socket holder using a base member with a plurality of spaced holes designed to receive the bosses of cylindrical posts. Posts correspond to standard socket drive units whereby sockets are mounted thereon.

U.S. Pat. No. 4,410,095 entitled "Interlocking Modular Article Supporting System and Component Units Therefore" which issued on Oct. 18, 1983 to Dembicks shows an interlocking modular system for wall mounting a variety of tools.

U.S. Pat. No. 4,421,230 entitled "Package for Articles of Manufacture" which issued on Dec. 20, 1983 to Stanton shows a multiple package for displaying sockets, each individual package including a three layer structure having a plurality of projections extending therethrough. Sockets are slidably mounted on said projections. The individual packages are joined by scoring to allow said individual packages to be separated from the multiple package for sale.

U.S. Pat. No. 4,621,738 which issued in 1988 to DeLucchi discloses a socket holder comprising a plurality of studs configured to receive the sockets, said studs being slidably mounted on a slot.

U.S. Pat. No. 4,927,020 entitled "Holder for Socket Wrench Heads" which issued on May 22, 1990 to Randy shows a socket wrench head holder using posts mounted within slots.

U.S. Pat. No. 4,717,106 entitled "Display Bracket for Sockets and Package Employing Same" which issued on Jan. 5, 1988 to Bies et al. provides a display bracket for sockets and a package employing same.

U.S. Pat. No. 5,407,063 entitled "Socket Tray with Adjustable Socket Guides" which issued on Apr. 18, 1995 to Warner et al. discloses a socket tray which automatically adjusts V-shaped holders to retain sockets.

None of the known prior art disclose the device set forth herein.

SUMMARY OF THE INVENTION

It is an object of this invention to provide an improved socket holder system which can be customized for use by the individual user.

It is a further object of this invention to provide an improved socket holder system which provides an add-on capacity as desired.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which:

FIG. 1 is a perspective view of one embodiment of the present invention showing four interlocking socket holders with end caps;

FIG. 2 is a perspective view of an individual interlocking piece depicted in FIG. 1;

FIG. 3 is a cross sectional view of the interlocking piece of FIG. 2 taken along line 3—3;

FIG. 4 is a top view of the interlocking piece depicted in FIG. 2;

FIG. 5 is a bottom view of the interlocking piece depicted in FIG. 2;

FIG. 6 is a perspective view of a doughnut magnet comprising a component of the interlocking piece of FIG. 2;

FIG. 7 is a right side view of the right side end cap shown in FIG. 1;

FIG. 8 is a left side view of the right side end cap shown in FIG. 1;

FIG. 9 is a top view of the right side end cap shown in FIG. 1;

FIG. 10 is a bottom view of the right side end cap shown in FIG. 1;

FIG. 11 is a right side view of the left side end cap shown in FIG. 1;

FIG. 12 is a left side view of the left side end cap shown in FIG. 1;

FIG. 13 is a top view of the left side end cap shown in FIG. 1;

FIG. 14 is a bottom view of the left side end cap shown in FIG. 1;

DESCRIPTION OF THE PREFERRED EMBODIMENT

Figure 15:
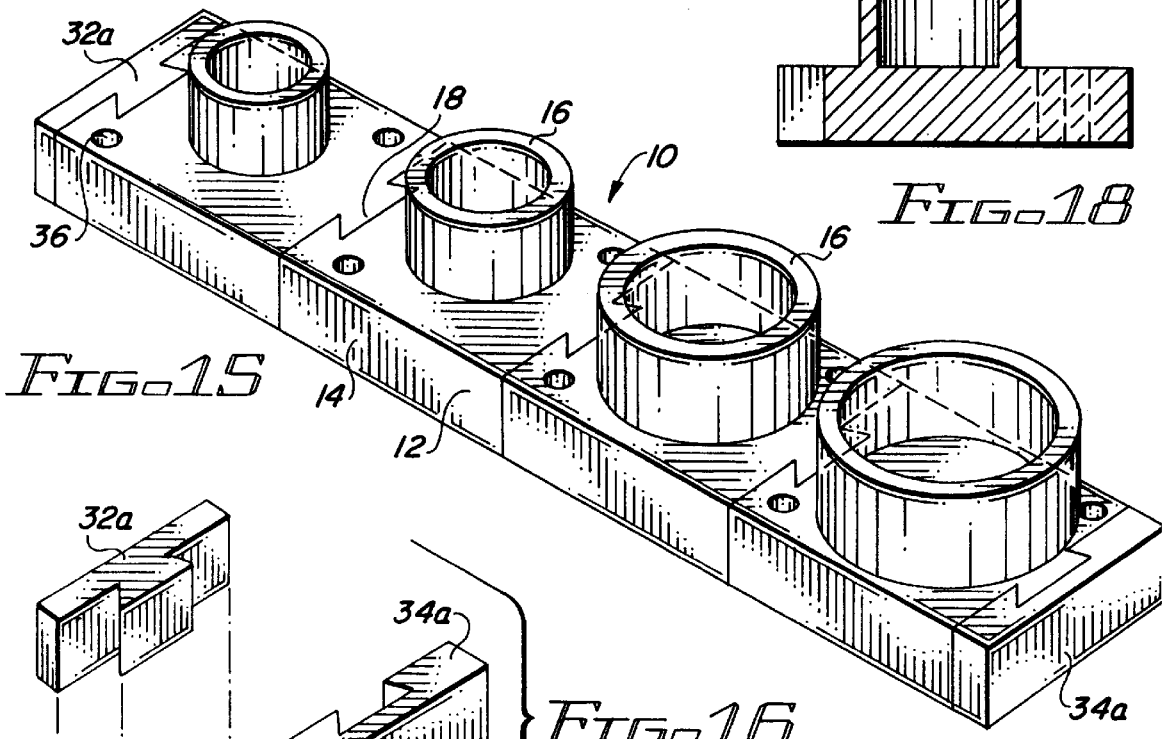
FIG. 15 is a perspective view of another embodiment of the present invention showing four interlocking socket holders with end caps.

Referring more particularly to the drawings by characters of reference, FIGS. 1–14 disclose a socket holding system 10 which comprises a plurality of interlocking socket holders 12. Each socket holder 12 comprising a base 14 and means for holding sockets 16 mounted thereon. Each base 14 interlocks with other bases 14, in this embodiment using a dovetail 18 and a matching groove 20 combination best seen in FIGS. 4 and 5. Further, each base 14 is securable to a substrate, if desired. Alternatively, every third or fourth base may be secured as discussed below.

As best shown in FIGS. 3, 4 and 6, socket holding means 16 comprises cylinders 22 having an open end and a closed end which are sized to receive sockets of differing diameters. In the illustrated embodiment, the diameter of cylinders 22 is a tenth of an inch larger than the diameter of the socket received therein. Further, a doughnut magnet 24 is mounted on the interior of the closed end of cylinder 22, preferably with an adhesive (not shown). Magnet 24 exerts enough force to hold the socket within cylinder 22 but allows for easy manual removal therefrom when desired.

Those skilled in the art will recognize that other methods of securing the socket within cylinder 22 are possible. For example, the socket could be friction fit within a plastic cylinder 22.

As best seen in FIGS. 2–5, base 14 is generally a solid rectangular shape. Preferably, one upper edge of the solid rectangular shape is chamfered thereby forming a sloping surface 26 at the front of base 14. Sloping surface 26 is used for indicia indicating the size of the socket held therein.

Also, in the embodiment of FIG. 1, each base 14 is the same length from front to back. However, the width from side to side varies depending on the outer diameter of cylinder 22.

As best seen in FIGS. 3 and 4, base 14 also preferably includes a countersunk hole 30. Hole 30 is suitable for use in mounting base 14 to assorted substrates with the insertion of a screw or other attachment device (not shown) as desired.

As seen in FIGS. 2–5, dovetail 18 is mounted on one side of base 14 while groove 20 is formed in the opposing side of base 14. From the top or bottom as seen in FIGS. 4 and 5, dovetail 18 presents a fan-shaped profile which extends laterally outward from base 14. However, as best seen in FIGS. 2 and 3, dovetail 18 does not extend the full height of base 14.

As also seen in FIGS. 4 and 5, groove 20 presents the same fan-shaped profile as dovetail 18 but extends laterally inside base 14 opposite dovetail 18. Groove 20 is open at the bottom and the side whereby groove 20 can be slid over and thereby receive dovetail 18. Neither dovetail 18 nor groove 20 extend to the top of base 14. Thus, when socket holders 12 are interlocked and secured to a substrate, the socket holders 12 cannot be dislodged from each other without substantial effort. For example, in FIG. 1, to remove a specific socket holder 12, all socket holders 12 and end caps 34 positioned to its right as viewed facing the sloping surface 26 must be removed first. Thus, this embodiment allows the user to secure only every third or fourth base to a substrate and still hold the interlocked but unsecured bases firmly thereto.

Figure 25:
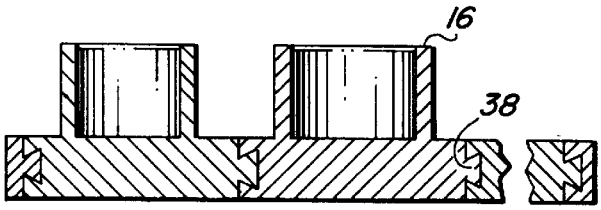
FIG. 25 is a cross sectional view of still another interlocking arrangement using the interlocking piece of FIG. 24.
Figure 24:
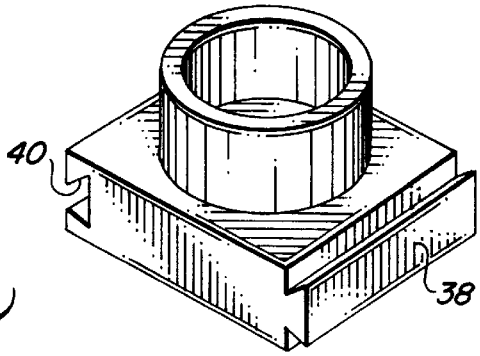
FIG. 24 is a perspective view of still another embodiment of an interlocking piece.

Those skilled in the art will realize that many other methods of interlocking socket holders 12 together are possible. Other possibilities are shown in FIGS. 24 through 27. For example, instead of a vertical dovetail 18 which presents a fan shaped profile from the top or bottom as shown in FIGS. 4 and 5, a horizontal dovetail 38 which presents a fan shaped profile from the side is presently preferred as seen in FIGS. 24 and 25. In this embodiment, the horizontal dovetail 38 which mates with a corresponding horizontal groove 40 extends the length of base 14. To interlock socket holders 12, groove 40 is open at front whereby it can be slid onto dovetail 38 from the front or back of socket holder 12.

Figure 26:
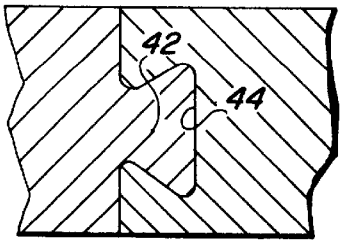
FIG. 26 shows an interlocking piece having rounded corners.
Figure 27:
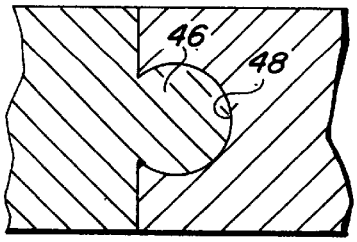
FIG. 27 shows an interlocking piece using a circular interlocking arrangement.

FIGS. 26 and 27 show variations of the dovetail shape which can be utilized if desired. FIG. 26 shows a smooth cornered dovetail 42 mating with a smooth cornered groove 44 in which the acute angle corners illustrated to this point have been smoothed and rounded. FIG. 27 shows a round protuberance 46 mating with a circular profile cavity 48 to provide interlocking. Many other arrangements such as tongue and groove, snap fittings and the like could be employed to interlock socket holders 12 as desired.

To add to the aesthetics of the system, a male end cap 32 having a dovetail 18 as best seen in FIGS. 11–14 and a female end cap 34 having a groove 20 as best seen in FIGS. 7–10 are optionally provided. Male end cap 32 is received within a mating groove 20 while female end cap 34 receives a mating dovetail 18. As an optional feature, either end cap 32 or 34 or both are color coded to denote the drive size of sockets contained within socket holders 12 attached therebetween.

Figure 18:
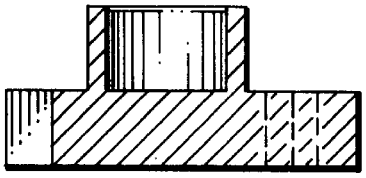
FIG. 18 is a cross sectional view of the single interlocking piece of FIG. 16 taken along line 18—18.
Figure 16:
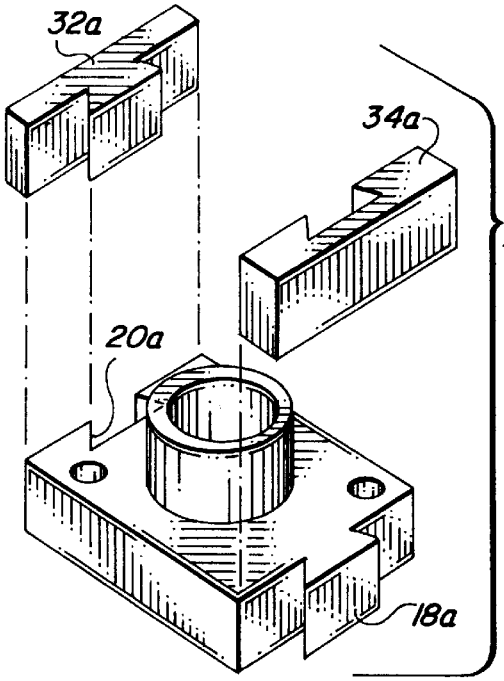
FIG. 16 is an exploded view of one interlocking piece and two end caps of the embodiment of FIG. 15.
Figure 19:
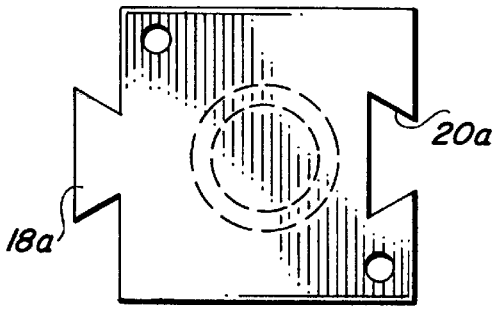
FIG. 19 is a bottom view of the single interlocking piece depicted in FIG. 16.
Figure 17:
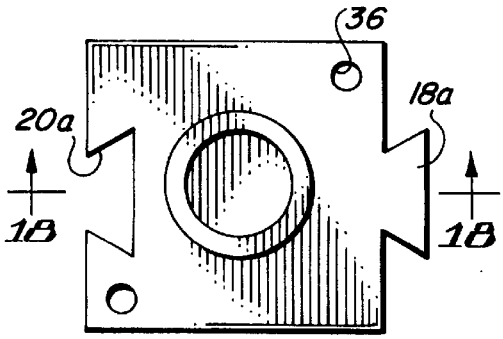
FIG. 17 is a top view of the single interlocking piece depicted in FIG. 16.

The embodiment of FIG. 15 allows the easy removal, addition or replacement of socket holders 12 is desired. In this embodiment, dovetails 18 and grooves 20 are equal in height to base 14 as shown in FIGS. 16 and 18. In addition, unlike the embodiment of FIG. 1, each base 14 will have the same width from side to side whereby bases 14 having different cylinders 22 can be easily interchanged. To even further facilitate removal and replacement, socket holder 12 is attachable to various substrates using holes 36, best seen in FIGS. 17 and 19, which are positioned in the corners of base 14.

Thus, unlike the embodiment of FIG. 1, other socket holders 12 need not be removed to disengage a single socket holder 12 from the substrate. In addition, once disengaged from the substrate, socket holder 12 can be merely lifted upward to be removed. Since, socket holders 12 have the same width, any desired size can be reinserted in its place.

Figure 20:
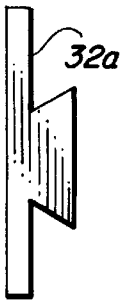
FIG. 20 is a top view of the end left side end cap depicted in FIG. 16.
Figure 21:
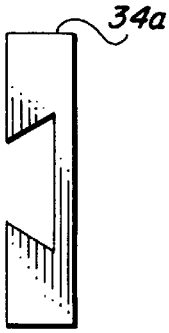
FIG. 21 is a top view of the right side end cap depicted in FIG. 16.

To accommodate this embodiment, end caps **32*a* and 34*a* are modified as seen in FIGS. 16, 20 and 21 to have dovetails 18*a* and grooves 20*a* which are the same height as base 14**.

Figure 22:
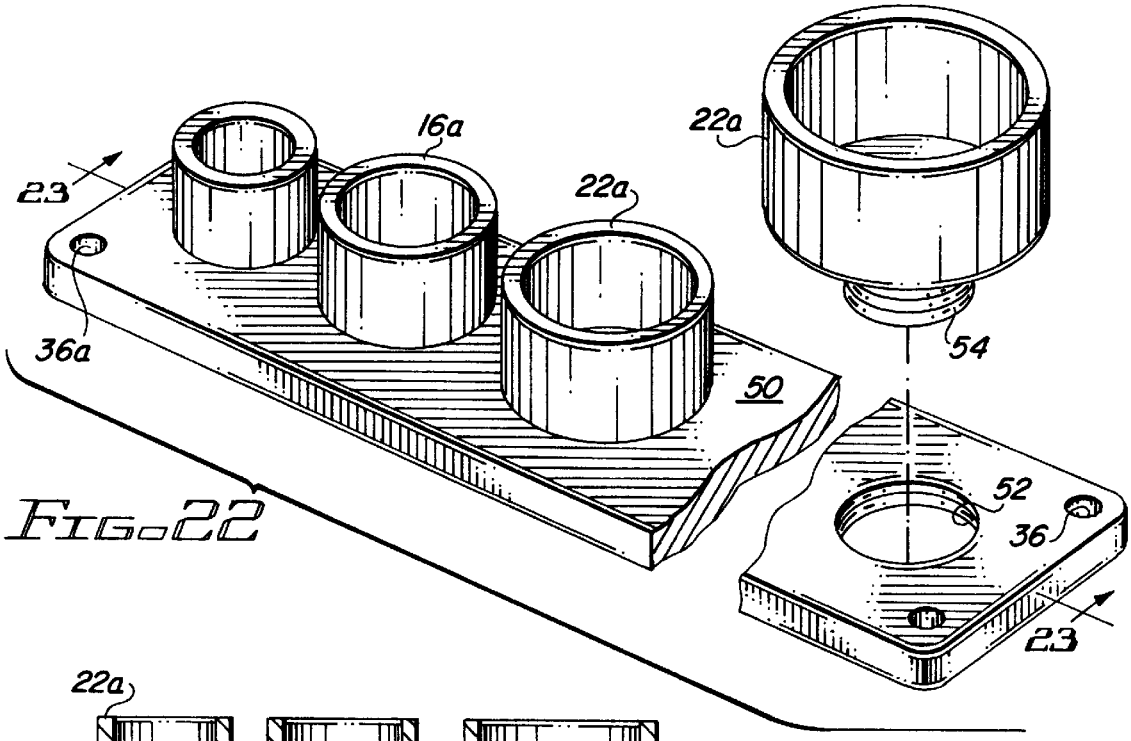
FIG. 22 is a perspective view of a third embodiment of the present invention showing four socket holders which screw into a base plate.
Figure 23:
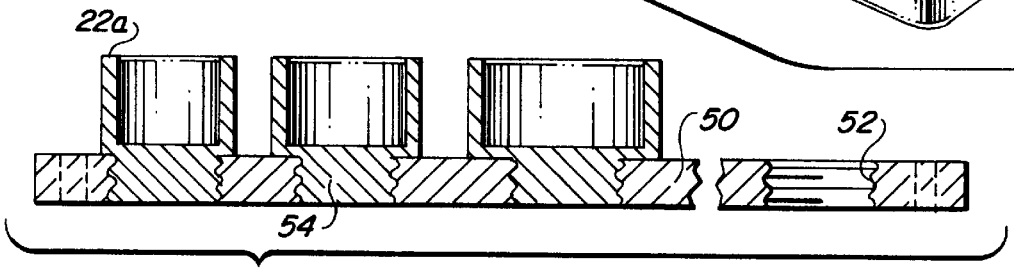
FIG. 23 is a cross sectional view of the embodiment of FIG. 22 taken along line 23—23.

Still another embodiment shown in FIGS. 22 and 23 employs a continuous strip base 50 having threaded holes 52 extending therein. In this embodiment, socket holding means **16*a* comprises cylinders 22*a* have a threaded portion 54 which extends downwardly from the closed end. Threaded portions 54 mate with corresponding threaded holes 52 in strip base 50. It is preferred that only one size thread be employed to allow easy replacement or addition of the cylinders 22*a*. This embodiment can have the cylinders 22*a* equally spaced as in the embodiment of FIG. 15 or spaced to accommodate differing sizes as shown in FIG. 1. In addition, strip base 50 is mounted to various substrates using holes 36*a*** in the corners thereof.

The advantages of the present system will be apparent to those skilled in the art. A user purchases only those socket holders needed for the sockets the user owns. The user can arrange the socket holders and hence the sockets in any desired arrangement. Possible arrangements include ordering by size or by frequency of use. The system can be mounted virtually any place such as a wall or the top of a workbench or in a toolbox.

It is presently contemplated that the invention described herein may be employed with a tray having a base which will accommodate four staggered rows of socket holders and take up the width of a typical top tray of a toolbox. Each tray will have handles at either end secured to the base. Socket holders 12 will be secured to the tray by screws. Trays would accommodate either metric or english measure sockets with color coding being used to distinguish between them.

Although only certain embodiments have been illustrated and described, it will be apparent to those skilled in the art that various changes and modifications may be made therein without departing from the spirit of the invention or from the scope of the appended claims.

What is claimed is:

1. A socket holding system comprising:

a plurality of interlocking socket holders, each of said holders having a base and a cylinder having an open end and a closed end, each of said cylinders being sized to receive sockets of differing diameters, each of said cylinders having a magnet positioned at the closed end of the cylinder, the magnet exerting enough force to hold a socket within each of said cylinders, each of said bases of said holders having means for interlocking with another of said bases mounted on opposing sides of each said base to form longitudinally interlocked bases, and each of said bases of said holders further having means for securing said base to a substrate.

2. The socket holding system of claim 1, wherein the cylinder has a diameter adapted to be 0.10 inch larger than a diameter of a socket.

3. The socket holding system of claim 1 wherein the base is a solid rectangular shape.

4. The socket holding system of claim 3, having a sloping surface formed on the base, the sloping surface suitable for having indicia imprinted thereon.

5. The socket holding system of claim 3 wherein each base has the same length.

6. The socket holding system of claim 1 wherein means for securing the base to a substrate comprises a countersunk hole centered in the closed end of the cylinder.

7. The socket holding system of claim 6 wherein the means for releasably holding sockets comprises a doughnut shaped magnet positioned at the closed end of the cylinder, the magnet exerting enough force to hold the socket within said cylinder, the doughnut shape leaving the countersunk hole exposed.

8. The socket holding system of claim 1 wherein the interlocking means comprises a dovetail and a mating groove combination on each base, the dovetail being positioned on one side of the base, the groove being positioned on the side of said base opposite said dovetail.

9. The socket holding system of claim 8 further having at least one end cap for covering the dovetail or the groove if not in use for interlocking.

10. The socket holding system of claim 9 wherein the at least one end cap is color coded.

11. The socket holding system of claim 8 wherein the dovetail extends laterally outward from the base and is shorter than the base in height.

12. A socket holding system comprising:

a plurality of interlocking socket holders, each of said socket holders being of differing sizes to receive sockets of differing diameters, each of said holders having a base and means for holding sockets mounted thereon, each of said bases of said holders having a dovetail and a mating groove combination, the dovetail being positioned on one side of the base, the dovetail extending laterally outward from the base and being equal in height to the base, the groove being positioned on the side of said base opposite said dovetail, each of said bases of said holders further having means for securing said base to a substrate.

13. The socket holding system of claim 12 wherein each base is of the same width and length.

14. The socket holding system of claim 13 wherein means for securing the socket holder to a substrate comprises holes positioned at each corner of the base.

15. A socket holding system comprising:

a plurality of interlocking socket holders, each of said holders having a base and means for holding sockets mounted thereon, wherein each of said bases of said holders is permanently joined to form a strip, the strip including threaded holes extending therein, the socket holding means comprising cylinders having an open end and a closed end, the cylinders further having a threaded portion extending downwardly from the closed end, the threaded portions mating with the threaded holes in the strip, each of said bases of said holders further having means for securing said base to a substrate.

16. The socket holding system of claim 15 wherein the threaded holes are equally spaced on the strip.

* * * * *